US012570425B2

(12) United States Patent
Marano et al.

(10) Patent No.: US 12,570,425 B2
(45) Date of Patent: Mar. 10, 2026

(54) SLAT EXCHANGE SYSTEM IN THERMO-WELDING MACHINES HAVING CELLS OR ALVEOLAR CAVITIES

(71) Applicant: AMC S.R.L., Naples (IT)

(72) Inventors: Angelo Marano, Naples (IT); Fabio Marano, Naples (IT)

(73) Assignee: AMC S.R.L., Naples (IT)

( * ) Notice: Subject to any disclaimer, the term of this patent is extended or adjusted under 35 U.S.C. 154(b) by 154 days.

(21) Appl. No.: 18/471,983

(22) Filed: Sep. 21, 2023

(65) Prior Publication Data

US 2024/0101296 A1 Mar. 28, 2024

(30) Foreign Application Priority Data

Sep. 23, 2022 (IT) ..... 102022000019590

(51) Int. Cl.
*B65B 59/04* (2006.01)
*B65B 57/18* (2006.01)

(52) U.S. Cl.
CPC ..... *B65B 59/04* (2013.01); *B65B 57/18* (2013.01)

(58) Field of Classification Search
None
See application file for complete search history.

(56) References Cited

FOREIGN PATENT DOCUMENTS

| | | | |
|---|---|---|---|
| CN | 208976599 | U | 6/2019 |
| CN | 111645951 | A | 9/2020 |
| CN | 112810863 | A | 5/2021 |
| EP | 3733381 | A1 | 11/2020 |
| FR | 2963322 | A1 | 2/2012 |
| WO | 2015086764 | A1 | 6/2015 |

OTHER PUBLICATIONS

Machine English translation of FR2963322, Accessed Apr. 11, 2025 (Year: 2012).*
Italian Search Report for IT 202200019590 dated May 10, 2023, 7 pages.

* cited by examiner

*Primary Examiner* — Abbas Rashid
*Assistant Examiner* — Adrianna N Konves
(74) *Attorney, Agent, or Firm* — NIXON & VANDERHYE

(57) ABSTRACT

A slat exchange system in thermo-welding machines having cells or alveolar cavities and similar systems, adapted to be adopted on a thermo-welding machine having cells or alveolar cavities and/or a similar system having a chain conveyor, a transmission chain, and an IT management apparatus, and being characterized in that it includes: at least one fixed slat part permanently connected to the chain conveyor; at least one removable slat part with one or more shapes adapted to be hooked and unhooked from the fixed slat part in order to be exchanged with another; at least one hooking and unhooking mechanism with a pin, a handle and a bar with spring, installed on the fixed slat part and adapted to allow hooking and unhooking the removable slat part.

20 Claims, 4 Drawing Sheets

SLAT EXCHANGE SYSTEM IN THERMO-WELDING MACHINES HAVING CELLS OR ALVEOLAR CAVITIES

CROSS-REFERENCE TO RELATED APPLICATIONS

This application claims the priority under 35 USC 119(a) of Italian Patent Application No. 102022000019590 filed on Sep. 23, 2022, the entirety of which is incorporated herein by reference.

BACKGROUND OF THE INVENTION

Field of the Invention

The invention relates to the field of industrial thermo-sealing. Even more specifically, the invention is adapted to provide an innovative system for changing the modules of a chain conveyor in a thermo-welding machine having cells or alveolar cavities.

Description of the Related Art

Packaging machines are industrial machinery developed in recent years, especially in the food packaging sector. Thanks to the spread of large-scale retail trade, the need to protect foods and increase their shelf life, understood as a conservation period, has grown, as much as possible counteracting chemical, microbiological, physical, structural and sensorial changes which are in any case inevitable over time, in agreement with Parisi's First Law of Food Degradation.

Thermo-welding machines are packaging machines for welding reeled films (polypropylene, polyester, or other plastic films) onto pre-formed plastic trays, or onto special molds to give particular shapes. The possibility of creating a vacuum inside the container and introducing inert gases makes them the most used packaging machines in food packaging. The high production capacity is also a distinctive feature of these machines which, thanks to the chain conveyor with alveoli, allow efficient management of the tray advancement.

The chain conveyor is in most cases constrained to a specific type of alveolar shape. The great variability of existing containers, for marketing reasons, makes it necessary to vary the shape in the conveyor chain lines of the thermo-welding machines. In particular in those with chain conveyor with alveoli, changing the alveolar shape is a big problem as it requires the replacement of the entire chain conveyor, unscrewing every single element to be able to replace it. This action not only requires many hours with disruption to production, but puts the operators at risk during the slat changing operations and is potentially dangerous; the risk of damage to the machine due to assembly errors is very high. To date, some solutions have been presented to avoid this problem, and in general inventions related to innovative thermo-welding systems, of which some examples follow.

One example is the object of patent application CN112810863A of C. XIAOMEI and G. MINHENG. The invention relates to the technical field of packaging machines, and describes a food packaging machine of the thermo-welding type. The machine consists of a belt conveyor, support frames, an upper roller, storage racks, a lower roller, a side plate, a transmission roller assembly, a pressure roller, a thermo-welding block and a thermo-welding assembly, the conveyor is connected to the conveyor belt, the two support frames are arranged on a frame at the upper end of the conveyor belt, the upper roller is positioned on the two support frames. The two storage racks are arranged on a frame in the lower part of the conveyor belt, and the lower roller is positioned on the two storage racks. According to the thermo-welding-type food packaging machine, when the conveyor belt and the conveyor run, the food on the conveyor can slide onto the films of the lower roller, the upper roller passes through the transmission roller assembly, and then passes through the pressure roller and the thermo-welding block, thereby the lateral edges of the two layers of film are subjected to thermo-welding in the thermo-welding block, under the operation of the pressure roller, the thermo-welded films move together with the conveyor belt, and finally, in the thermo-welding assembly, the films with the food are cut and subjected to thermo-welding.

Another example is the object of patent application WO2015086764A1 of A. ROSSINI. The invention relates to a packaging device. The packaging device comprises a welding and cutting station for welding a film on the edge of a tray and cutting said film, characterized in that it comprises a support surface comprising a plurality of housings housing a plurality of molds, said molds being of different dimensions and/or formats to accommodate trays of different dimensions and/or formats, said support surface being drivable to bring one of said molds at said welding and cutting station.

Another example is the object of patent application CN111645951A of L. CHEN and S. CHEN. The invention relates to a rapid thermo-welding machine for food packaging bags. The rapid thermo-welding device comprises a base, a support plate is fixedly mounted to the upper end of the base, symmetrical limiting blocks are fixedly connected to the front end of the support plate, a dragging disk is rotatably connected to the upper parts of the support plate limiting blocks at the front ends of the support plate, a movable plate is slidingly connected between the limiting blocks, the upper end of the movable plate is fixedly connected with a guide frame extending to the guide disk, a telescopic column is fixedly installed at the front end of the movable plate, a spring rod is fixedly connected to the lower end of the telescopic column, and symmetrical limiting rods are fixedly installed at the upper end of the base. According to the rapid thermo-welding device for food packaging bags, the guide disk rotates to guide the guide frame, so that a thermo-welding plate moves up and down. The thermo-welding plate is moved by the telescopic column, and the pressing rods fix the thermo-welding plate, so as to obtain the effects of rapid thermo-welding, correct adjustment of the thermo-welding time according to the packaging materials, and improvement of the thermo-welding quality of the packaging bag.

Another example is the object of patent application CN208976599U of Z. MIN, L. SHUWEN and L. HUA. Universal thermoforming mold sets capable of being quickly changed. The invention claims a heating module comprising an upper matrix and a lower matrix. The upper matrix and the lower matrix are fixedly connected to the outlet of the heating equipment through relative heating plates. The mold core is developed independently and is fixed in the groove of the heating module by screws, and can be replaced by unscrewing the screws and extracting it.

The inventions reported so far, purely by way of example and not exhaustively, are representative of the inventive-technological framework available to date.

The object of the present invention is to propose an innovative slat exchange system in thermo-welding machines having cells or alveolar cavities and/or similar systems, capable of solving the technical problems linked to wear of the pins, to clamping which may not be perfect (with risk of damage of the machinery or of injury for the operators), as well as long lead times with considerable production stops, typical of the existing solutions for changing slats which involve dismantling the slat itself from the chain conveyor through bolted unions.

Even more advantageously, the system lends itself to being completely automated, thus allowing the slats on the chain conveyor to be changed through a robot and significantly speeding up the format change process with all the advantages deriving therefrom.

SUMMARY OF THE INVENTION

According to the present invention, a slat exchange system in thermo-welding machines having cells or alveolar cavities and similar systems is provided which is capable of allowing the locking and unlocking of slats with alveoli along the chain conveyor, adapted to interchange the shapes in order to be able to weld different container models with the same machine.

The system comprises a slat divided into two parts, a fixed part connected to the chain conveyor with a bolted union, and a removable part on which the alveoli (or shapes) are present. The removable part can be unhooked from the fixed one through a hooking and unhooking mechanism and can be used on both of its sides, thus providing the possibility of using different alveoli on the same removable slat part.

The hooking and unhooking mechanism comprises a pin which inserts inside a symmetric groove made on the side of the removable slat part. The pin has a flat lower part and a slanting upper part, in order to allow locking the removable slat part simply by pressure, and preventing the accidental unhooking thereof. When the removable slat part is inserted by pressure, the pin snaps inside the symmetric groove, hooking it and a contrast bar, positioned on the bottom of the fixed slat part, provides support for the pressure. The pin is connected to a handle and a bar with spring. By moving the handle backwards (away from the slat) the pin then slides along the spring bar, and it is possible to remove the removable slat part. The spring bar can be replaced using magnetic, electromagnetic, hydraulic or other technology so as to have different types of machinery for automating the disassembly process.

The removable slat part is also designed so that it can house multiple modules which can be moved and recombined in order to allow for a greater number of alveoli (shapes) and to generally guarantee greater versatility.

The system comprises a check sensor which analyzes the alignment between the two parts of the slat. When these are misaligned, the thermo-welding machine is locked and a warning is sent. The sensor is also capable of measuring the distance between the edge of the fixed slat part and the end of the alveoli (or shapes). These distances are communicated to the IT system which manages the processes of the thermo-welding machine. In fact, when the thermo-welding machine is started, the IT system receives all the distances corresponding to the processes to be carried out and, if these are different from those measured by the check sensor, the IT management system locks the thermo-welding machine and sends a special warning. In fact, a difference between measurements is indicative of misalignments, or of slats mounted with the wrong set of shapes; in any case, locking the system prevents breakages and malfunctions.

The system thus designed can be easily automated by using a robot capable of unhooking the removable slat part, automatically manipulating the hooking and unhooking mechanism and positioning it in common racks or housing boxes. The robot instead hooks the removable slat part by simply pressing it against the slanting upper part of the pin which then moves back and allows the removable slat part to enter into position in the fixed part.

The release of the removable slat part, whether it is carried out manually by one or more workers, or in an automated manner, can be facilitated by using a profiled stick which is fixed in a position along the chain conveyor of the thermo-welding machine. The profiled stick automatically unlocks the hooking and unhooking mechanism when the slat slides forward; in fact, the handle slides along the profiled edge of the stick and reaches the unlocked position. Thereby the unlocked removable slat parts can be picked up by the robot or by a single operator; the length of the stick obviously determines how many slats are unlocked at the same time.

The advantages offered by the present invention are evident in the light of the description given up to now and will be even clearer thanks to the appended figures and the related detailed description.

BRIEF DESCRIPTION OF THE DRAWINGS

The invention will be described hereinafter in at least one preferred embodiment by way of non-limiting example with the aid of the appended figures, in which.

DETAILED DESCRIPTION

The present invention will now be illustrated by way of a purely non-limiting or binding example, resorting to the figures which illustrate some embodiments with respect to the present inventive concept.

Figure 1:
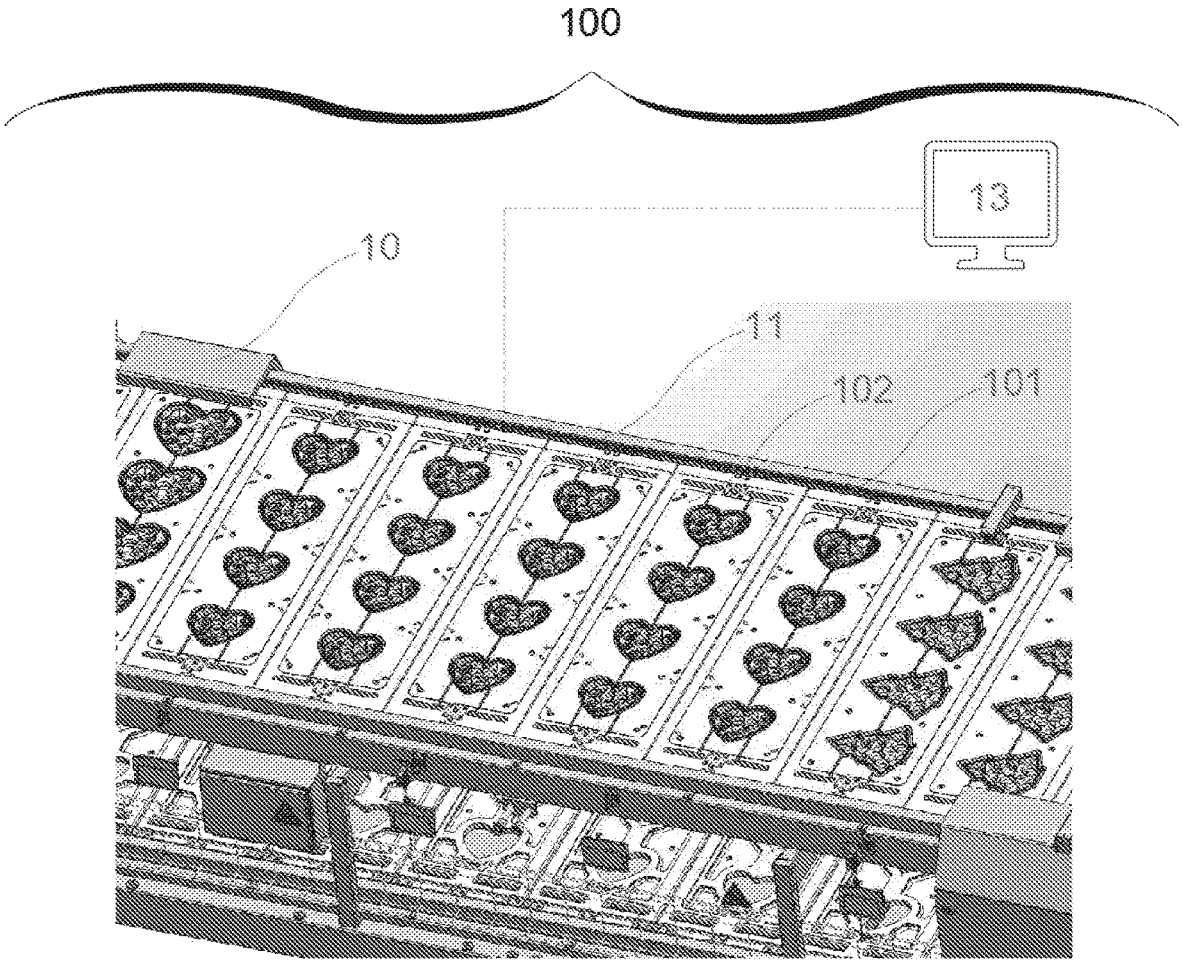
FIG. 1 shows a general view of the slat exchange system in thermo-welding machines having cells or alveolar cavities and similar systems 100 implemented on a thermo-welding machine having cells or alveolar cavities 10.

With reference to FIGS. 1, 2, 3 and 4 show general and detailed views of said slat exchange system in thermo-welding machines having cells or alveolar cavities and similar systems 100 according to the present invention. In FIG. 1 as in the following description, the embodiment of the present invention currently considered the best is illustrated.

Said slat exchange system in thermo-welding machines having cells or alveolar cavities and similar systems 100 adapted to be adopted on a thermo-welding machine having cells or alveolar cavities 10 and/or a similar system having a chain conveyor 11, a transmission chain 12, an IT management apparatus 13, comprises at least one fixed slat part 101 with a contrast bar 105, at least one movable slat part 102 with shapes 103 and a symmetric groove 104, at least one hooking and unhooking mechanism 110 with at least one pin 111, at least one handle 112 and at least one bar with spring 113, a check sensor 120, a robot 130, a profiled stick 140.

Specifically, FIG. 1 shows a perspective view of said thermo-welding machine having cells or alveolar cavities 10 with said chain conveyor 11, on which various units of said fixed slat part 101 and said removable slat part 102 are arranged in series.

Figure 2:
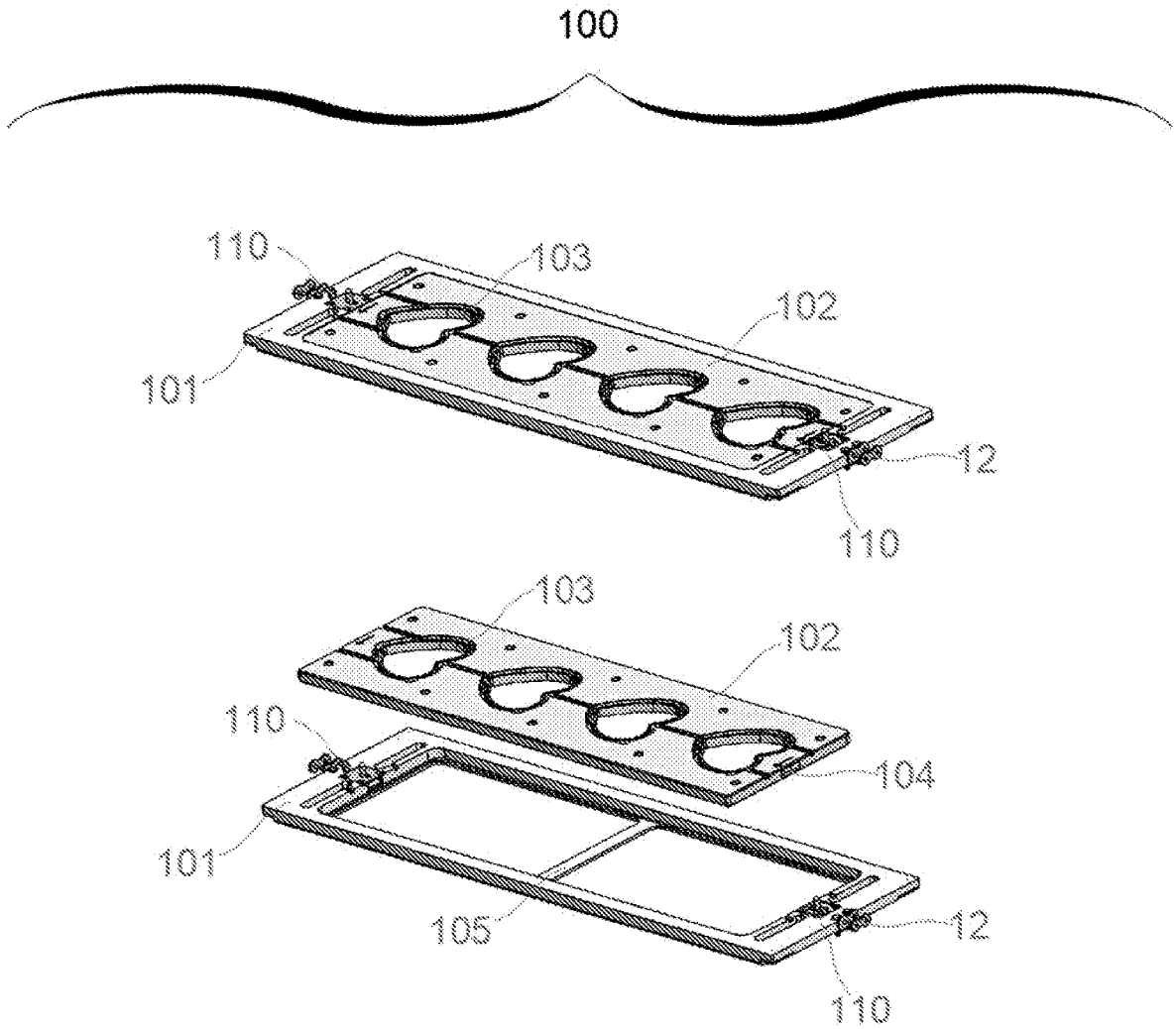
FIG. 2 shows two detail views of said slat exchange system in thermo-welding machines having cells or alveolar cavities and similar systems 100.
Figure 3:
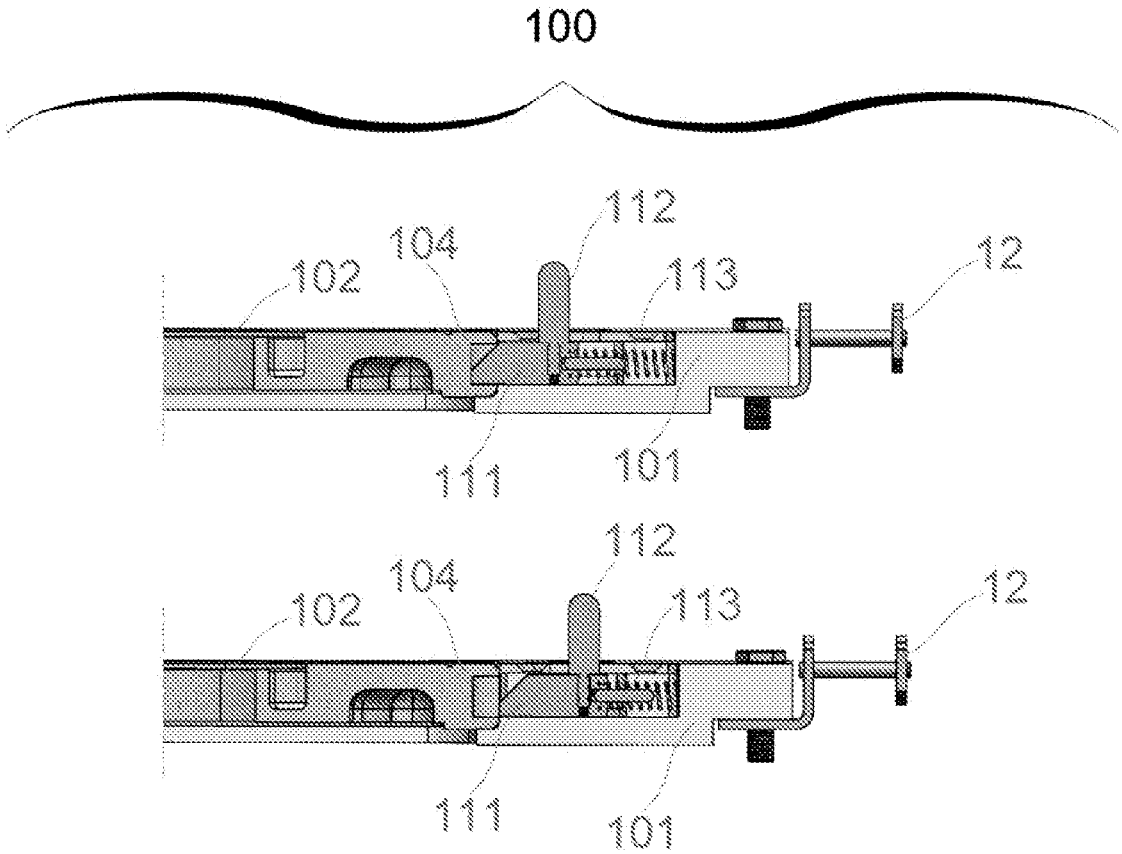
FIG. 3 shows two detail views of said slat exchange system in thermo-welding machines having cells or alveolar cavities and similar systems 100.

FIG. 2 shows a detail of said fixed slat part 101 and said removable slat part 102 in the constrained and released configurations, it is in fact possible to observe said removable slat part 102 inserted inside or released and shown on the outside of said fixed slat part, and it is possible to observe said hooking and unhooking mechanism 110 and said contrast bar 105. Said hooking and unhooking mechanism 110 is shown in detail in FIG. 3 in the locked and unlocked configuration. In the locked configuration, said pin 111 is located inside said symmetric groove 104 of said removable slat part 102 and said bar with spring 113 is in a rest condition. In the unlocked configuration, said pin 111 is moved back within the shape of said fixed slat part 101, applying force on said handle 112 and said bar with spring 113 is in a compressed condition, in this configuration said removable slat part 102 is released and can therefore be extracted from said fixed slat part 101.

Figure 4:
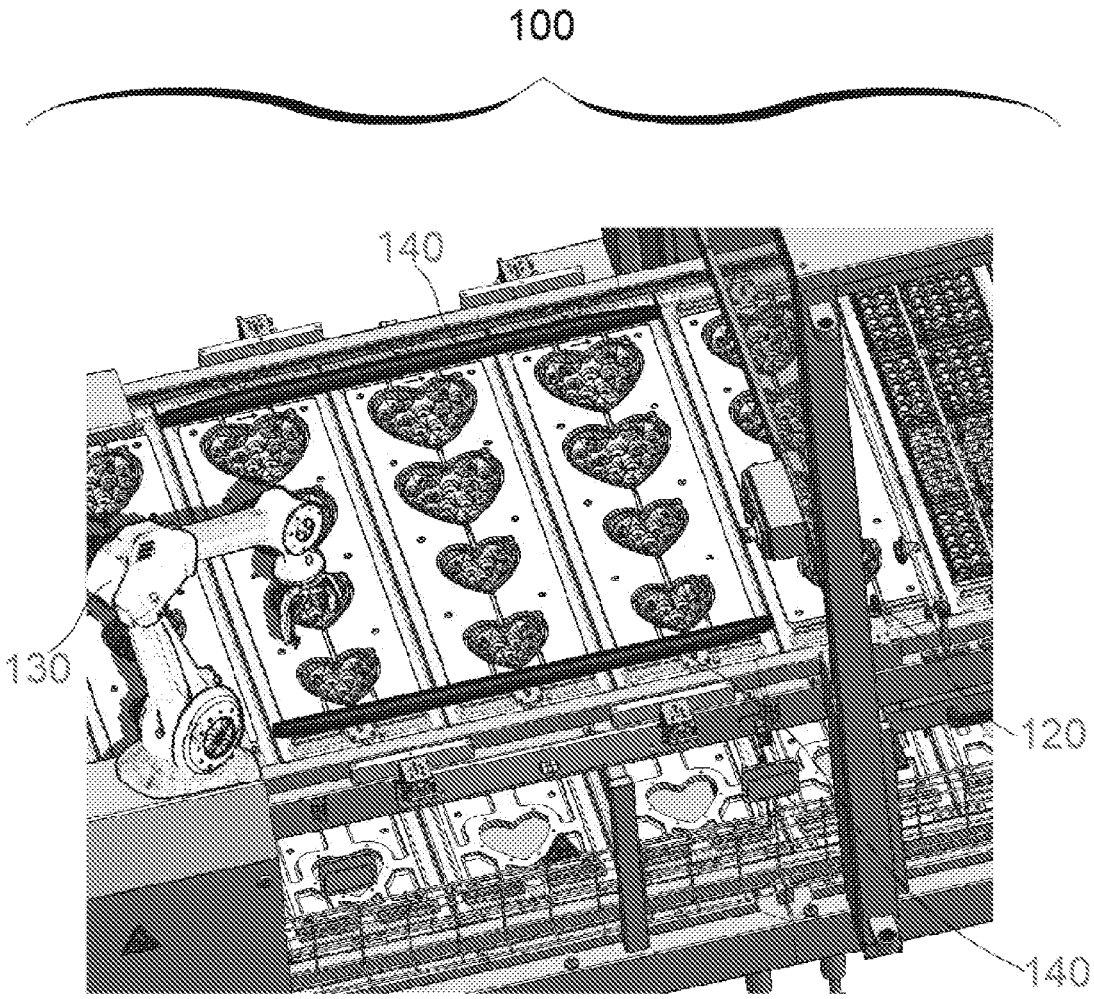
FIG. 4 shows a general view of said slat exchange system in thermo-welding machines having cells or alveolar cavities and similar systems 100.

FIG. 4 lastly shows a perspective view of the portion of the thermo-welding machine having cells or alveolar cavities 10 where said check sensor 120, said robot 130, and two units of said profiled stick 140 are installed. The units of said profiled stick rod 140 ensure that said handle 112 of three units of said hooking and unhooking mechanism 110 slide simultaneously and position themselves in the unlocking configuration to subsequently allow said robot 130 to move said removable slat part 102.

Finally, it is clear that modifications, additions or variations which are obvious to a person skilled in the art can be made to the invention described up to now, without thereby departing from the scope of protection provided by the appended claims.

The invention claimed is:

1. A slat exchange system in thermo-welding machines having cells or alveolar cavities, a chain conveyor, and an IT management apparatus, said system comprising:

at least one fixed slat part permanently connected to said chain conveyor;

at least one removable slat part having one or more shapes/profiles and adapted to be reversibly hooked to and unhooked from said fixed slat part in order to be exchanged with another removable slat part having different shapes/profiles and/or for maintenance reasons; wherein said removable slat part is provided with a symmetric groove arranged in central position within a wall thickness of said removable slat part;

at least one hooking and unhooking mechanism installed on said fixed slat part, adapted for allowing hooking and unhooking of said removable slat part in order to promote a swift exchange/replacement of the removable slat part.

2. The slat exchange system in thermo-welding machines having cells or alveolar cavities, according to claim 1, wherein said hooking and unhooking mechanism includes:

at least one pin configured to be inserted in said symmetric groove in order to engage with said removable slat part; said pin being provided with a flat lower part in order to lock said removable slat part, and with a slanting upper part in order to allow a facilitated insertion of said removable slat part;

at least one handle, connectable to said pin and projecting beyond said fixed slat part to ease the at least one handle's handiness;

at least one bar with a spring, adapted for allowing the backward sliding of said pin when, using said handle, the pin is retracted within the profile of said fixed slat part;

and adapted to put the pin again in an advanced position, pushing this pin into said symmetric groove of said removable slat part.

3. The slat exchange system in thermo-welding machines having cells or alveolar cavities, according to claim 1, wherein said fixed slat part comprises a holding bar, or counter pressure bar, in a lower zone, in order to provide a support during hooking of said removable slat part, as well as during the work/processing performed by said thermo-welding machine with cells or alveoli.

4. The slat exchange system in thermo-welding machines having cells or alveolar cavities, according to claim 1, wherein said removable slat part is usable on both sides thereof, thus allowing the use of shapes/profiles of the removable slat part's upper part, and the use of other shapes/profiles on the removable slat part's lower part, while eliminating the need of employing another set of slats.

5. The slat exchange system in thermo-welding machines having cells or alveolar cavities, according to claim 1, wherein said removable slat part is configured in such a way as to allow the assembling of several modules that are displaceable and combinable with one another, so as to permit the availability of a greater number of shapes/profiles and ensure an increased versatility.

6. The slat exchange system in thermo-welding machines having cells or alveolar cavities, according to claim 1, further comprising a check sensor adapted for analyzing the alignment between said removable slat part and said fixed slat part and for verifying a correct positioning thereof; wherein, if said check sensor detects an incorrect alignment between said removable slat part and said fixed slat part, the thermo-welding machine with alveoli is stopped and a warning is sent to prevent damage to a slat and/or the machine.

7. The slat exchange system in thermo-welding machines having cells or alveolar cavities, according to claim 6, wherein said check sensor is adapted for measuring a distance between an edge of said fixed slat part and the ends of said shapes/profiles and for communicating the distance to said IT management apparatus; wherein, at the start of working, said IT management apparatus receives data regarding all distances between the edge of said fixed slat part and the ends of said shapes/profiles, and if these differ from the distances measured by said check sensor, the IT management apparatus stops said thermo-welding machine with alveoli and sends a warning to an operator panel by communicating the actual format mounted on the chain conveyor; wherein said check sensor is also adapted to prevent accidental damages when said removable slat part has shapes/profiles different from those needed for the process.

8. The slat exchange system in thermo-welding machines having cells or alveolar cavities, according to claim 1, further comprising a robot adapted for unhooking said removable slat part, by automatically acting on said hooking and unhooking mechanism; wherein, said robot is adapted for engaging/hooking said removable slat part with/to said fixed slat part by allowing said removable slat part to reach said removable slat part's rest position inside said fixed slat part.

9. The slat exchange system in thermo-welding machines having cells or alveolar cavities, according to claim 1, further comprising a profiled stick fixed in a position along said chain conveyor of said thermo-welding machine with alveoli and suited to automatically unlock said hooking and unhooking mechanism by causing the sliding of said handle, in order to facilitate the manual operation of removal, or removal by said robot, of said removable slat part; wherein, said profiled stick has a length adapted for allowing the unhooking of one or more units of hooking and unhooking mechanisms.

10. The slat exchange system in thermo-welding machines having cells or alveolar cavities, according to claim 2, wherein said pin can be slid using said bar with spring or by means of magnetic or electromagnetic, or hydraulic systems, and/or other kinds of systems.

11. The slat exchange system in thermo-welding machines having cells or alveolar cavities, according to claim 2, wherein said hooking and unhooking mechanism can be implemented by different actuation systems.

12. The slat exchange system in thermo-welding machines having cells or alveolar cavities, according to claim 11, wherein the hooking and unhooking mechanism comprises an actuation system that is magnetic, pneumatic or electric.

13. The slat exchange system in thermo-welding machines having cells or alveolar cavities, according to claim 2, wherein said fixed slat part comprises a holding bar, or counter pressure bar, in a lower zone, in order to provide a support during hooking of said removable slat part, as well as during the work/processing performed by said thermo-welding machine with cells or alveoli.

14. The slat exchange system in thermo-welding machines having cells or alveolar cavities, according to claim 2, wherein said removable slat part is usable on both sides thereof, thus allowing the use of shapes/profiles of the removable slat part's upper part, and the use of other shapes/profiles on the removable slat part's lower part, while eliminating the need of employing another set of slats.

15. The slat exchange system in thermo-welding machines having cells or alveolar cavities, according to claim 3, wherein said removable slat part is usable on both sides thereof, thus allowing the use of shapes/profiles of the removable slat part's upper part, and the use of other shapes/profiles on the removable slat part's lower part, while eliminating the need of employing another set of slats.

16. The slat exchange system in thermo-welding machines having cells or alveolar cavities, according to claim 13, wherein said removable slat part is usable on both sides thereof, thus allowing the use of shapes/profiles of the removable slat part's upper part, and the use of other shapes/profiles on the removable slat part's lower part, while eliminating the need of employing another set of slats.

17. The slat exchange system in thermo-welding machines having cells or alveolar cavities, according to claim 2, wherein said removable slat part is configured in such a way as to allow the assembling of several modules that are displaceable and combinable with one another, so as to permit the availability of a greater number of shapes/profiles and ensure an increased versatility.

18. The slat exchange system in thermo-welding machines having cells or alveolar cavities, according to claim 3, wherein said removable slat part is configured in such a way as to allow the assembling of several modules that are displaceable and combinable with one another, so as to permit the availability of a greater number of shapes/profiles and ensure an increased versatility.

19. The slat exchange system in thermo-welding machines having cells or alveolar cavities, according to claim 4, wherein said removable slat part is configured in such a way as to allow the assembling of several modules that are displaceable and combinable with one another, so as to permit the availability of a greater number of shapes/profiles and ensure an increased versatility.

20. The slat exchange system in thermo-welding machines having cells or alveolar cavities, according to claim 13, wherein said removable slat part is configured in such a way as to allow the assembling of several modules that are displaceable and combinable with one another, so as to permit the availability of a greater number of shapes/profiles and ensure an increased versatility.

* * * * *